US005806028A

United States Patent [19]

Lyberg

[11] Patent Number: 5,806,028

[45] Date of Patent: Sep. 8, 1998

[54] METHOD AND DEVICE FOR RATING OF SPEECH QUALITY BY CALCULATING TIME DELAYS FROM ONSET OF VOWEL SOUNDS

[75] Inventor: Bertil Lyberg, Vagnharad, Sweden

[73] Assignee: Telia AB, Farsta, Sweden

[21] Appl. No.: 601,508

[22] Filed: Feb. 14, 1996

[30] Foreign Application Priority Data

Feb. 14, 1995 [SE] Sweden ..... 9500520

[51] Int. Cl.[6] ..... G10L 5/06

[52] U.S. Cl. ..... 704/231; 704/239; 704/246; 704/248; 704/235

[58] Field of Search ..... 395/2.79, 2.86; 704/231, 237–240, 246, 248, 235

[56] References Cited

U.S. PATENT DOCUMENTS

| | | | |
|---|---|---|---|
| 4,805,219 | 2/1989 | Baker et al. | 395/2.5 |
| 5,109,418 | 4/1992 | Van Hemert | 395/2.22 |
| 5,222,147 | 6/1993 | Koyama | 395/2.58 |
| 5,393,236 | 2/1995 | Blackmer et al. | 434/169 |
| 5,557,706 | 9/1996 | Geist | 395/2.81 |
| 5,664,050 | 9/1997 | Lyberg | 704/251 |

*Primary Examiner*—Allen R. MacDonald
*Assistant Examiner*—Alphonso A. Collins
*Attorney, Agent, or Firm*—Oblon, Spivak, McClelland, Maier & Neustadt, P.C.

[57] ABSTRACT

A method and device for determining quality of speech. The speech to be evaluated is listened to by a person who reproduces the speech. The end of vowel sounds in the produced and reproduced speech respectively are determined. The difference between the ends of the vowel sounds is registered. From the obtained time differences an average value is determined. The average value indicates the quality of the produced speech. The invention can be used for evaluation of different speech sources.

9 Claims, 3 Drawing Sheets

METHOD AND DEVICE FOR RATING OF SPEECH QUALITY BY CALCULATING TIME DELAYS FROM ONSET OF VOWEL SOUNDS

TECHNICAL FIELD

The present invention refers to the rating of speech quality in a given speech. The speech source which is analyzed can be a synthesized speech or from different persons.

STATE OF TECHNOLOGY

Most methods for finding out the quality of synthetic speech at text-to-speech conversion are concentrated on the segmental realization, by perception tests with nonsense words, for instance, ("appa," "ippi," "agga," etc.,) This method says little or nothing about how good the synthetically produced speech is and how useful it is in applications. To solve this problem one has started studying cognitive stress at the use of synthetic speech, for example by making the subject of the experiment perform different tasks at the same time as he/she is exposed to information by synthetic speech, the content of which he/she has to give an account of.

In synthetic speech the non-primary parameters are to a large extent lacking, which results in that the interacting parameters in many cases give contradictory information, which then results in that the comprehension is lower than with natural speech. Especially in noisy environments the listener has a need of these non-primary signal parameters which results in that the comprehension of synthetic speech is drastically diminished in such surroundings.

In U.S. Pat. No. 4,672,668, there is described how a system pronounces a stored standard word with defined length, stress and rhythm. A person repeats the standard words and tries to simulate the length, stress and rhythm. The repeated words are detected and processed for determining whether certain critera concerning identity of the standard words pronounced by the system are complied. If the repeated word complies with the criteria of identity it will be stored as a reference word.

In U.S. Pat. No. 5,282,475, there is described a technology which is assigned to audiometry. A sequence of speech stimuli is presented to a person in which surveillance is made of at least one physiological answer from the human subject of the experiment which varies according to the subject's reception (i.e. understanding).

In U.S. Pat. No. 5,303,327, there is described a method in which a verbal stimuli is presented to a person, after which the answer to the verbal stimuli is registered. The answers deal with statements and/or receptivity.

DESCRIPTION OF THE INVENTION
TECHNICAL PROBLEM

There is a need for evaluating total quality, including prosody in, for instance text-to-speech conversion.

The methods used today for evaluating total quality are based on trials with a large number of persons. These persons deliver an opinion on the quality of the speech in question. There is a need to find methods which are automatic and do not need to use a number of persons participating in the evaluation.

In situations where it is a question to chose between different speakers it can be of importance to find the speaker who is most easy to comprehend. Thus methods for quick evaluation of such speakers and choosing the one who probably is most easy to comprehend is desirable. A further problem is that certain groups of people have more difficulties in perceiving speech than others. Even in this situation it is desirable to find methods where grading of the quality of a speech in relation to the capacity of the group of listeners can be defined.

Methods which are usable for synthetic speech and pathological speech are lacking at present. The possibilities for studying social disabilities are also wanted.

SOLUTION

The present invention refers to a method of determining speech quality. A speech which is produced is being listen to by a person who repeats the speech. The vowels of the produced and reproduced speech, respectively, are identified. Further the times for the start of each vowel sound are identified. A time difference between the corresponding starts of vowel sounds are established. The resulting time difference indicates the quality of the produced speech.

The reproduction of the speech is performed by a person listening to the speech and verbally reproducing it as soon as possible.

The speech is produced in a text-to-speech converter and consists of one recorded-in-advance message which is reproduced by, for instance, a tape recorder.

A reference to the quality of the produced speech is achieved by calibration of the system. This is performed by reading a speech with one quality known in advance. The person who repeats the calibration message will repeat the message with some delay in relation to the original message. In this way a reference is achieved, at which different persons' repeating of the message are comparable. The calibration procedure permits that consideration can made of, for instance, a person's daily form. The method further allows that in order to ensure the speech quality of a text-to-speech converter, different persons, or human speech recorded on, for instance, a tape recorder, can be used in the calibration procedure.

The invention further refers to a device for deciding speech quality. A first speech source 5 is arranged to produce a speech. The produced speech is analyzed and reproduced by a second speech source 1. A quality determination unit 7, appoints the starts of the vowel sounds in the produced and reproduced speech respectively. In the quality determination unit 7 a time difference between the corresponding starts of vowel sounds in the produced and reproduced speech is registered. The time difference indicates a measure of the quality of the speech and is via the quality determination unit 7 presentable.

The first speech source 5 in FIG. 1, consists of a text-to-speech converter for production of a speech. Further, the second speech source 1 consists of a person. He/she is listening in to the produced speech which will be repeated by the person. The second speech source 1, consisting of a person, shall reproduce the reproduced speech as soon as possible after he/she has listened to it. In the quality determination unit 7 time differential analysis equipment is arranged to calculate the time difference between the start of vowels in the produced and reproduced speech. The quality determination unit 7 is further arranged to give a certificate of quality of the produced speech. The time difference equipment in the quality determination unit 7 is further arranged to create an average value of the obtained time differences. The average value indicates the quality of the produced speech. The quality determination unit 7 is further arranged to comprise a first speech recognition unit 2 for appointing the start of a vowel sound in the produced speech. Further it comprises a second speech recognition unit 3, for appointing the start of a vowel sound in the reproduced speech.

For calibration of the equipment, a calibration source 6 is used according to FIGS. 3 and 4, which is arranged to be connected instead of the first speech source 5.

The calibration source is arranged to produce a speech the quality of which is known in advance. In this way a reference is obtained in relation to the second speech source 1, consisting of a person who has been used for the reproduction of the speech. A reliable evaluation of the produced speech is thus obtained independent of the second speech source 1, consisting of a person.

ADVANTAGES

The present invention has the advantage of measuring speech quality including prosody. In previously known methods of measuring only segmented quality has been measured.

At the production of synthetic speech from a text different text-to-speech converters can be compared.

The invention can be used for evaluating social disabilities in connection with pathological speech.

By having a speech with a given quality as a reference a graded system for different speeches can be obtained. This is achieved by a number of reference speeches with, for instance, the grades very good, good and poor being used. The given speech can, after analysis, be appointed to belong to one of the mentioned categories.

DETAILED EMBODIMENT

In the following the invention is described with reference to the figures and the designations therein.

Figure 1:
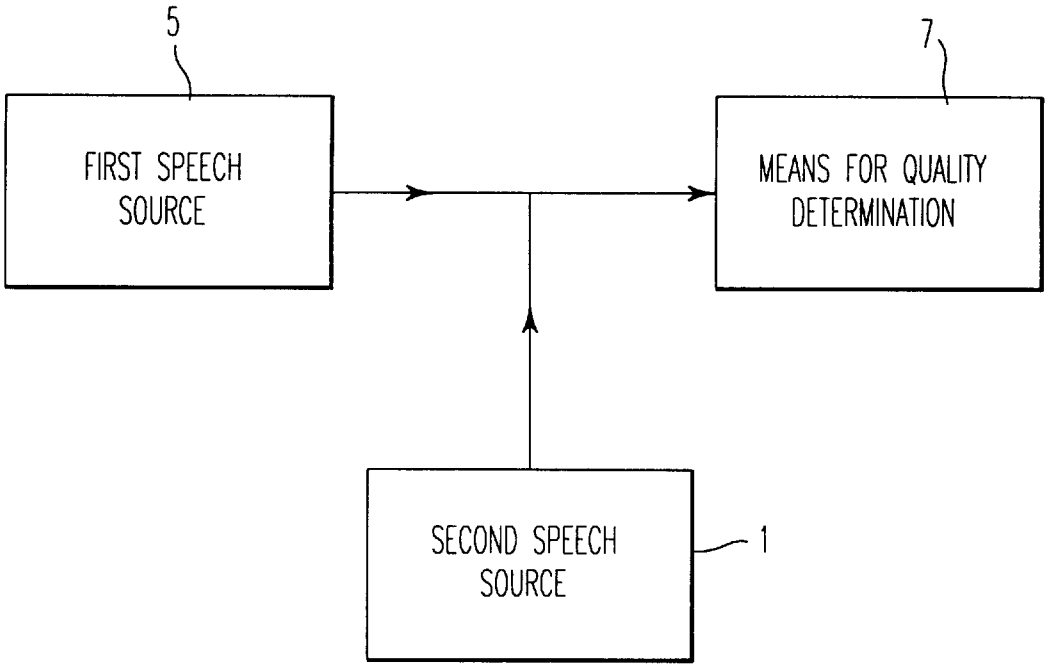
FIG. 1 shows the essential composition of the system.

According to FIG. 1 speech is produced in a first speech source 5. The speech is transferred in parallel to a second speech source 1 and a quality determination unit 7. In the second speech source 1 the speech is listened to and reproduced. The produced and reproduced speech is transferred to a quality determination unit 7. Analysis of the speeches then takes place and vowel sounds in each speech is identified. For each vowel sound the start of the vowel sound is determined. In the quality determination unit 7, times for the start of vowel sounds in each speech are obtained. The times for the starts of the vowel sounds are analyzed.

The time difference between the starts of vowel sounds in the speeches is determined. If it is assumed that the starts of the vowel sounds in the produced speech are marked V1, V2, V3, etc., and the starts of the vowel sounds in the reproduced speech are marked V1', V2', V3', etc., the differences can be marked X1, X2, etc., where X1=V1'−V1, X2=V2'−V2, etc. The average value of these differences is obtained by $$E(X) = 1/N \sum_{i}^{N} xi$$

The grading of the produced speech is obtained by the fact that the larger the time delay in the reproduced speech is in relation to the produced speech, the worse the understanding of the reproduced speech. The grading of the quality of the speech can for instance be referred to different time intervals within which the reproduced speech can be reproduced.

Figure 3:
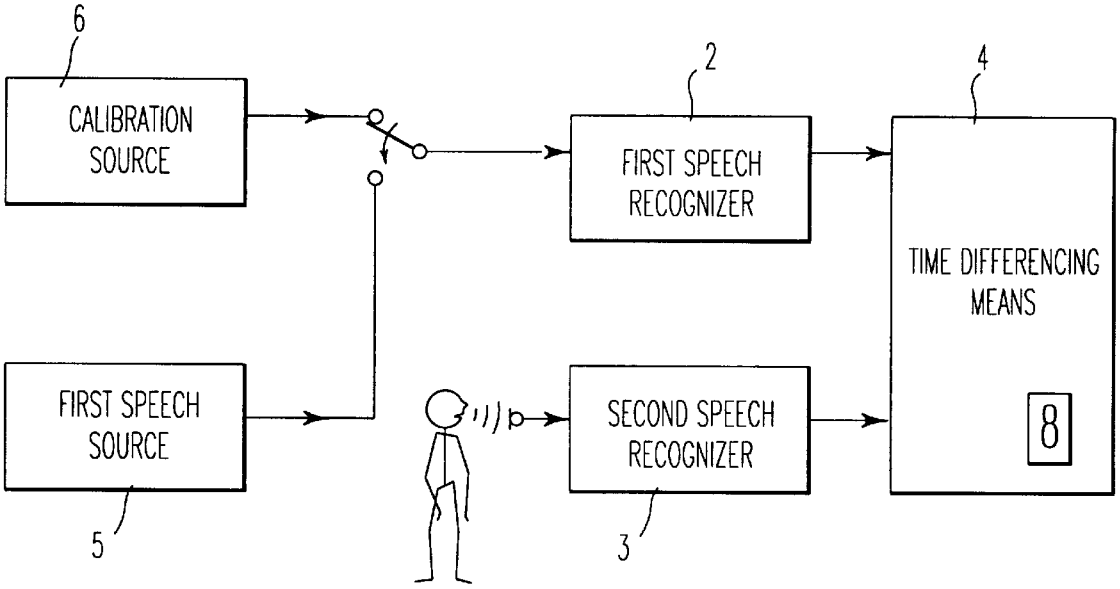
FIG. 3 shows how a calibration source 6 has been connected to the system and is reproduced by a person before the first speech source 5 is connected for an analysis of the given speech.

In FIG. 3 is shown how a speech is produced in the first speech source 5 acting as a text-to-speech converter. The speech is transferred to the first speech recognition unit 2 and to a second speech source 1, consisting of a person who has the duty to, as soon as possible, verbally reproduce the speech in a microphone which is connected to the second speech recognition unit 3. In the first speech recognition unit 2 the starts of the vowel sounds in the produced speech are appointed. In the second speech recognition unit 3 the starts of the vowel sounds in the verbally reproduced speech are appointed. In the time differencing unit 4 a difference between the starts of the vowel sounds of the produced speech and the reproduced speech is produced. A pecularity which can occur at the reproduction of speech with a person as reproducer is that a person out of the given speech and its delivery can predict the coming speech. This means that the human being at the reproduction of the speech in certain cases can reproduce the speech at the same time or even ahead of the speech production device. Also in this case a difference is created between the starts of the vowel sounds in the time differencing unit 4.

It is possible in this case to obtain an average which is close to 0, which indicates that the speech is very well understandable.

By making different categories of people listen to the same speech, different kinds of, for instance, impaired hearing can be compared. Text-to-speech converters can in these cases in an adequate way be adapted to the need of different person categories. For instance, persons with different kinds of impaired hearing can be analyzed, and, for those people, suitable equipment be produced.

For obtaining an adequate grading some form of reference system is required. In FIG. 3 such a system is shown where a calibration source 6 is connected to the system. The text which in this case is read by the equipment is, for instance, categorized in advance by subjective measurements. Such subjective measurements are performed, for instance, in sound laboratories. Changing between the calibration source and the first speech source is made via the switch. The stored message in first speech source 5 can, for instance, consist of messages of different quality. The quality determination unit receives information related to the quality of the present speech. This is displayed in the quality determination unit and the result is stored in a memory which is arranged in the quality determination unit. A system with arbitrary division of the grading is thus achieved. The stored messages in the calibration source 6 preferbly consist of messages recorded on tape or other resistant medium. What is important is that the messages stored in the calibration source are the same at different reference alternatives to make things comparable. The time difference between the starts of the vowels of the produced and the reproduced speech are determined and an average is created according to the above-mentioned formula. The obtained average values at indicate the threshhold for different grades of speech.

Figure 4:
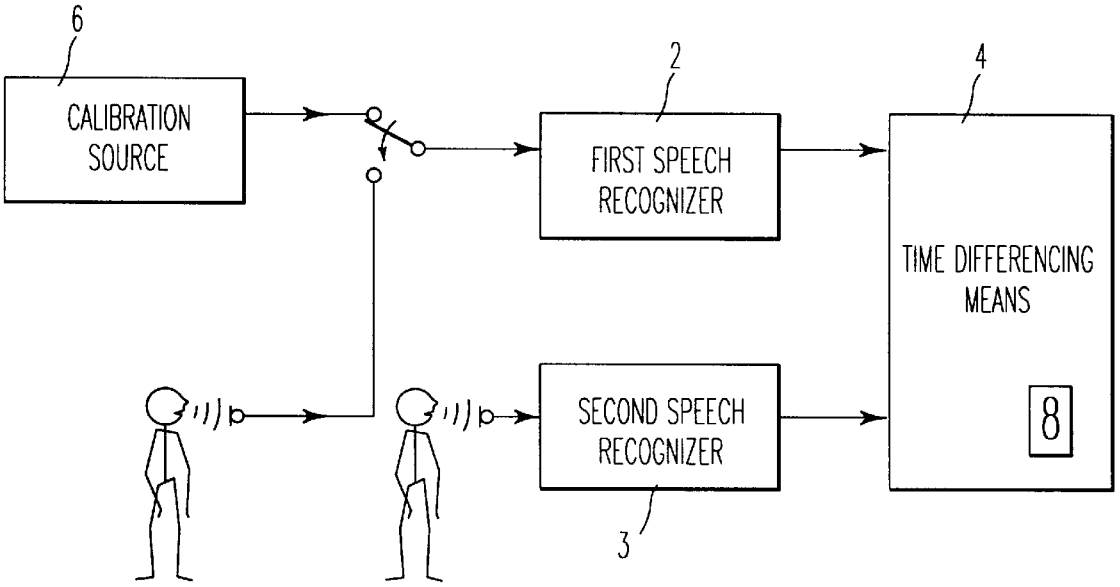
FIG. 4 shows the equivalent of FIG. 3 where the given speech is produced by a person and the reproduction is performed by a person.

FIG. 4 shows how the calibration source 6 is connected and a second speech source 1, consisting of a person who reproduces the speech. After a reference evaluation has been made, in this case a person reading a text is connected by switching the switch.

The verbal production from the first speech source 5 is being listen to and is being reproduced by the second speech source 1, consisting of a person and the speeches are analyzed as described above. By comparing the starts of the vowel sounds in each speech respectively, and making an average of these as has previously been described, and comparing the first speech source's 5 verbal production and the second speech source's 1 ability to reproduce the first speech source's 5 speech and comparing the obtained average value with the average value for the reference equipment, the time differencing unit 4 obtains an evaluation of the first speech source's 5 verbal production ability.

Thus it is possible to, starting from a reference applicated to the calibration source, find out whether a first speech source's 5, account can be reproduced and understandable to another person in relation to a reference. The second speech source 1, consisting of a person who repeats the speech can, for instance, be a person or a group of persons with different kinds of impaired hearing. The equipment in this case can be configured for selecting which person/persons shall speak to a certain kind of people. This can, for instance, be of crucial importance at lectures, lessons, etc., where persons with certain hearing disabilities are listeners. It iis in this case possible to tailor-make the lecturers/teachers. This can be of crucial importance for making a message reach the listeners.

Figure 2:
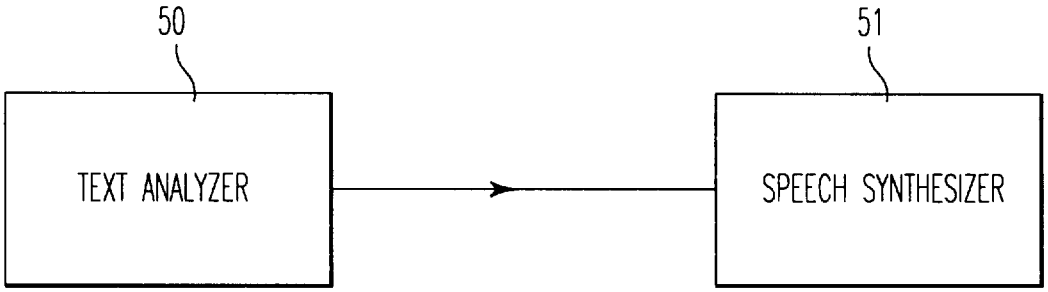
FIG. 2 shows how the first speech source 5 is divided into one text analysis equipment 50, and one speech synthetizing equipment, 51.

In FIG. 2 it is further shown how a first speech source 5 consisting of a text-to-speech converter according to the previous descriptions can be realized. In this case there occurs an analysis of the text in the text analyzer 50. The text is transferred to a speech synthetizing unit 51. The speech synthetizing unit produces a speech which corresponds to the given text. Both the text analyzer and the speech synthetizing unit have been previously introduced on the market. A fuller description of these is not necessary since the professionals in the field are familiar with these devices.

Figure 5:
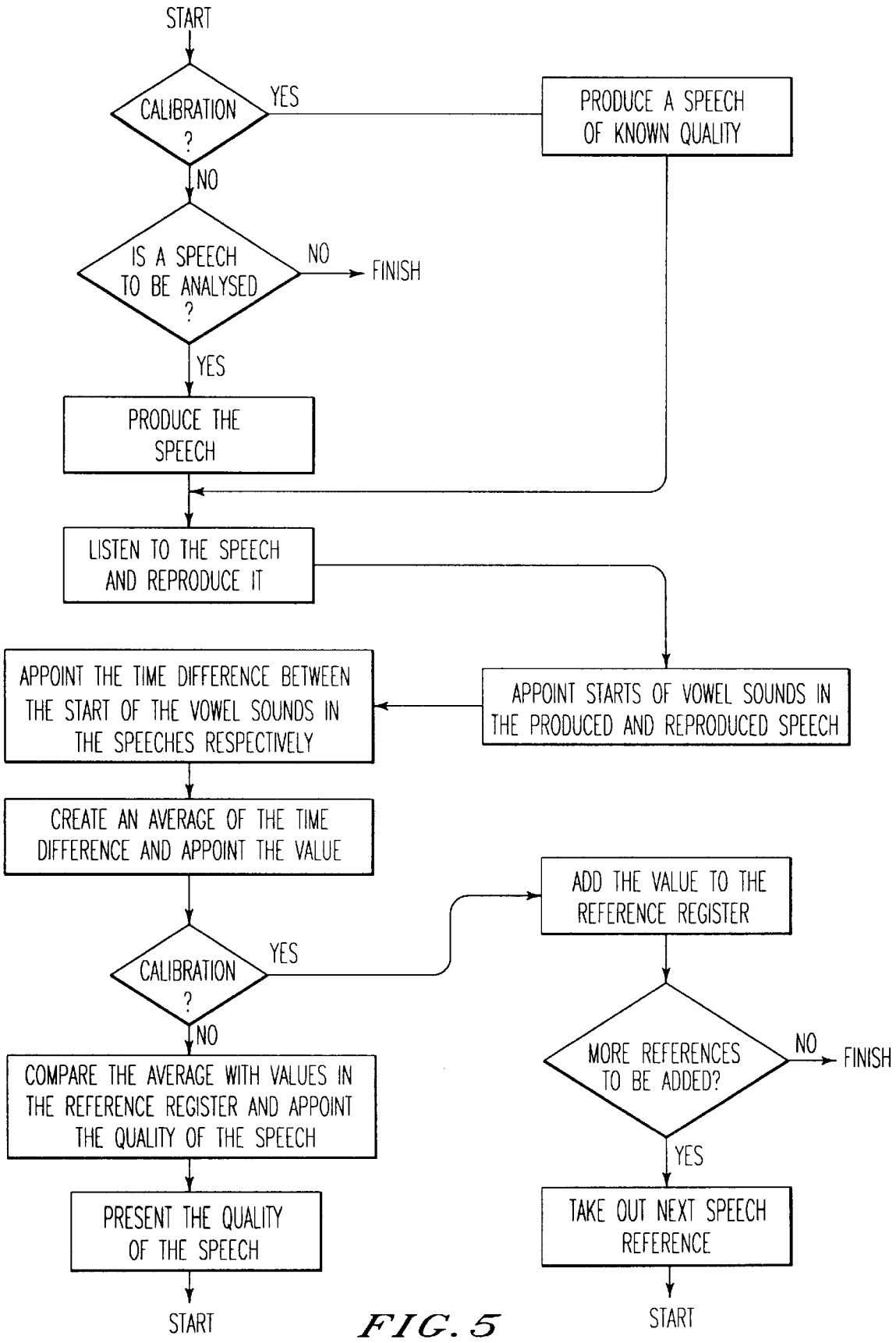
FIG. 5 shows the invention in the form of a flow chart diagram.

Referring to the flow chart in FIG. 5 the functionality of the invention can be described as first deciding whether calibration of the system shall be made or not. Depending on whether calibration shall be made or not, a speech with known quality is produced or, alternatively, the speech to be analyzed is produced. The produced speech is then listened to and reproduced. The starts of vowel sounds in the produced and reproduced speech respectively are measured. The time difference between the starts of the vowel sounds in the speeches respectively is determined. After that the average value of above-mentioned differences are created.

If the measured average value is aimed at a calibration of the system, the obtained result is placed in a reference register. After that, it is decided whether more references are to be placed in the system. If that is the case, the next speech reference is taken out and the procedure according to previous description is repeated. If all references have been gone through there is in this case, a restart.

If, on the other hand, the obtained average value was directed towards an evaluation of a speech produced by equipment or a person, a comparison with values in the reference register is then performed. the reference value which is closest to the quality of the produced speech is determined. The equipment then indicates the quality of the speech. After that,is decided whether further evaluations are to be made or not. If no further evaluations shall be performed the procedure will be finished; otherwise, the same procedure as above decribed is applied.

If one arranges a person to listen to read text and gives him/her the task to repeat the text, it turns out that the time difference between the speech repeated by the subject of the experiment and the speech that is read for him/her is not very large. Sometimes the subject of the experiment is even ahead due to the redundancy in the sentences which makes him/her predict the incoming speech. The chance of predicting the continuation of the incoming speech is obviously due to how much information is received from the start of the speech and up to the time in question. The signal parameters of the accoustic signal interact woth the production apparatus and the human brain in a unique way, resulting in the information being multidimensionally coded. Even signal parameters which are not primary are important for supporting the interpretation of a statement. The prosody (intonation) of the speech in the highest degree announces synthetic structure and interpretation of a statement.

Synthetic speech is to a large extent lacking in the non-primary signal parameters which causes the interacting parameters in many cases to give a contradictory information resulting in that the comprehensibility is lower than in natural speech. Especially in noisy surroundings the listener is needing these non-primary signal parameters which result in the comprehensibility being drastically lower in such surroundings.

By studying the time delay between the speech repeated by the subject of the experiment and the speech that is read to him/her by naturally produced speech and synthetic speech one can classify the speech quality of the synthetic speech. Due to the fact that the time delay will vary with automatic speech analysis, the time of the start of the vowel segments in the read alternative of the synthetizer-produced speech and the speech produced by the subject of the experiment will be decided. For each vowel in the speech string the time delay is appointed and the average delay calculated.

The method can also be used for comparing the quality of the speech of different speakers, and, for instance, judging the social disability for a person with speech disturbances. Comparisons between different text-to-speech converting devices can also be made.

The invention is not confined to the above or below-stated patent claims but can be subjected to modifications within the framework of the idea of the invention.

I claim:

1. A method for determining speech quality, comprising the steps of:

providing a first speech;

providing a second speech, wherein said second speech is a reproduction of said first speech; and determining time differences between corresponding starts of each vowel sound of each word in said first and second speech, wherein said time differences are a measure of a match of said first speech and said second speech and providing an output of said time differences.

2. A method as set forth in claim 1, wherein said step of providing a second speech comprises a person listening to and repeating said first speech.

3. A method as set forth in claim 1, wherein said step of providing a first speech comprises providing said first speech from a source selected from the group consisting of a text-to-speech converter, a person reading a text associated with said first speech, and an audio play-back device.

4. A method as set forth in claim 2, wherein said step of providing a first speech comprises providing a first speech of a known quality; and said step of determining the time differences comprises indicating a calibration associated with said first speech.

5. A method set forth in claim 1, further comprising the step of determining an average value of said time differences, wherein said average value indicates said measure of a match of said first speech and said second speech.

6. A method as set forth in claim 2, further comprising the step of categorizing said first speech according to a category of said person.

7. An apparatus for determining speech quality, comprising:

means for converting a first speech to a first electrical signal;

means for converting a second speech to a second electrical signal; and means for determining time differences between corresponding starts of each vowel sound of each word in said first speech and second speech based upon first and second electrical signals, wherein said time differences indicate a measure of a match of said first speech and said second speech and means for outputting said time differences.

8. An apparatus as set forth in claim 7, further comprising a source for producing said first speech, wherein said source is selected from the group consisting of a text-to-speech converter and audio play-back device.

9. An apparatus as set forth in claim 7, further comprising means for determining an average value of said first time differences, wherein said average value indicates said measure of a match of said first speech and said second speech.

* * * * *